United States Patent [19]

Underwood

[11] 4,447,157

[45] May 8, 1984

[54] FLUID MIXING SYSTEM WITH INDUCTOR CLEANOUT

[76] Inventor: Gene E. Underwood, P.O. Box 2685, Conroe, Tex. 77305

[21] Appl. No.: 394,658

[22] Filed: Jul. 2, 1982

[51] Int. Cl.[3] ..... B01F 5/10; B01F 15/02

[52] U.S. Cl. ..... 366/137; 366/165; 366/173

[58] Field of Search ..... 366/136, 137, 159, 163, 366/165, 173, 139, 138; 239/119

[56] References Cited

U.S. PATENT DOCUMENTS

| | | | |
|---|---|---|---|
| 3,001,720 | 9/1961 | Cartwright | 239/119 |
| 4,152,259 | 5/1979 | Molvar | 239/119 X |
| 4,170,420 | 10/1979 | Underwood | 366/137 |

*Primary Examiner*—Philip R. Coe

*Attorney, Agent, or Firm*—Wofford, Fails & Zobal

[57] ABSTRACT

A container having a center suction conduit with a plurality of inductors, a plurality of injectors for injecting fluid into the container and a pump for withdrawing fluid from the container by way of the inductors and center suction conduit and recirculating the fluid by way of the injectors. The pump has an inlet coupled to an outlet end of the center suction conduit and an outlet coupled to the injectors. Each inductor comprises a conduit which extends into the center suction conduit and which has an opening within the center suction conduit which faces the outlet end thereof. A lower suction conduit is coupled to the bottom of the container and to the inlet of the pump. A reverse flow conduit is coupled to the outlet of the pump and to the outlet end of the center suction conduit for allowing the pump to pump fluid from the container by way of the lower suction conduit and into the center suction conduit for cleaning out the inductors.

8 Claims, 7 Drawing Figures

FLUID MIXING SYSTEM WITH INDUCTOR CLEANOUT

FIELD OF THE INVENTION

The present invention relates to a fluid mixing system.

DESCRIPTION OF THE PRIOR ART

U.S. Pat. No. 4,170,420 discloses and claims a fluid mixing system which has been employed in the drilling industry for mixing drilling fluids. If the system is not operated properly, it has been found that the inductors become plugged when mixing lost circulation material such as cottonseed hulls, mica, etc. When such material is added to the container and the container is allowed to become too full whereby the fluid goes up into the access risers in the top of the container, which is out of the turbulence zone, the material will form lumps. When the contents of the container are discharged, these lumps plug the inductors.

SUMMARY OF THE INVENTION

It is an object of the present invention for providing a fluid mixing system having unique means for cleaning out its inductors.

The fluid mixing system comprises a container having a given length and injection means for injecting fluid into the container in a direction to cause the fluid to swirl around an axis along the length of the container. First section conduit means is located in the container generally along said axis and which has a plurality of spaced apart inlet means along its length for the flow of fluid from the container into the first suction conduit means. Each of the inlet means comprises an inductor conduit having a portion which extends into the first suction conduit means and which has an opening within the first suction conduit means which faces one end of the first suction conduit means. Pump means is provided having an inlet coupled to said one end of said first suction conduit means and an outlet coupled to the injection means. A second suction conduit means is coupled to the bottom portion of the container and to the inlet of the pump means. First valve means is coupled between said one end of said first suction conduit means and the inlet of the pump means. Second valve means is coupled between the outlet of the pump means and the injection means. Third valve means is coupled to the second suction conduit means. A reverse flow conduit means is coupled from the outlet of the pump means to the first suction conduit means at a position between the first valve means and said inlet means. Fourth valve means is coupled to the reverse flow means. The pump means is allowed to withdraw fluid from the first suction conduit means for flow to the injection means for injection back into the container when said first and second valve means are open and said third and fourth valve means are closed. The pump means is allowed to withdraw fluid from the container by way of the second suction conduit means for flow into said first suction conduit means by way of the reverse conduit means for cleaning out the inductor conduits when said third and fourth valve means are open and said first and second valve means are closed.

DESCRIPTION OF THE FLUID MIXING SYSTEM

Figure 1:
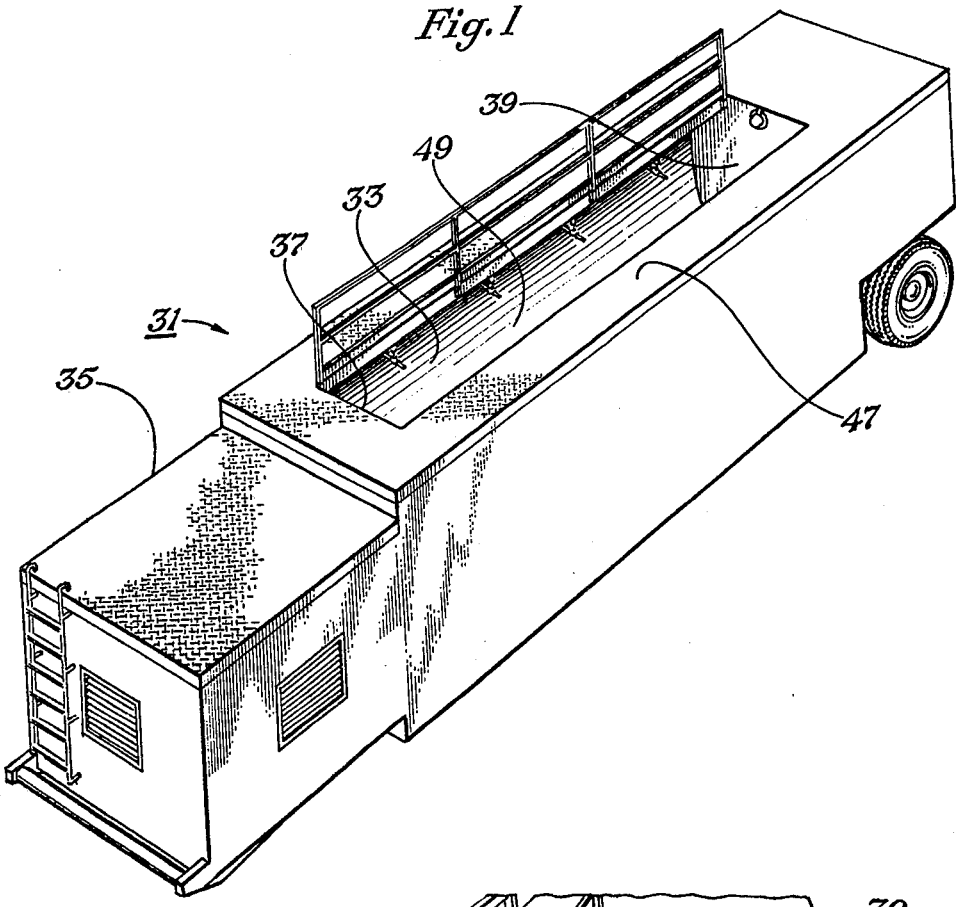
FIG. 1 is a perspective view of a fluid mixing system mounted in a mobile unit.
Figure 2:
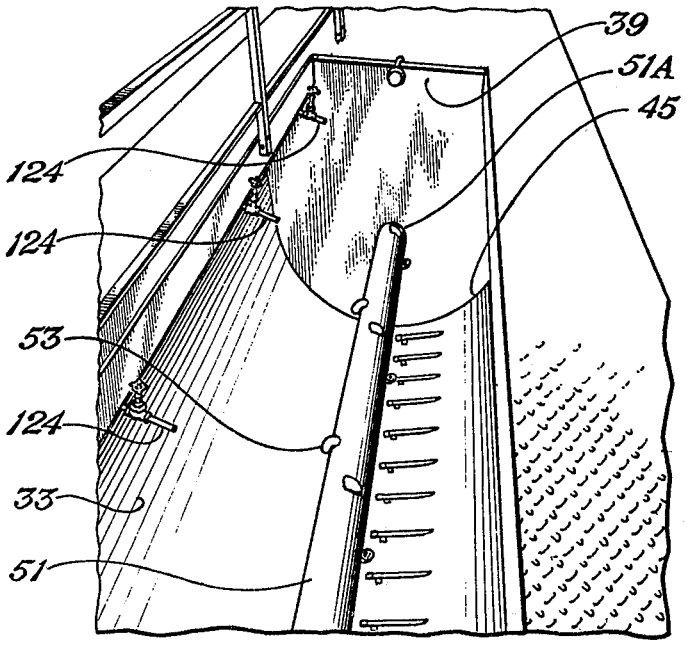
FIG. 2 is a view of FIG. 1 looking down into the container or vessel of the mixing system.

Referring now to the drawings, the fluid mixing system is identified at 31 and comprises a fluid container or vessel 33 and a mixing system for preparing drilling fluids for the drilling industry although it may be employed for preparing fluids for other uses. The drilling fluid prepared may be water based or oil based and may be prepared by mixing chemicals or other particles with water or oil to obtain a homogenous solution or a heterogenous mixture.

The container 33 is supported by a mobile unit 35. It is elongated and is formed by two spaced apart end walls 37 and 39, two side walls 41 and 43 and a rounded bottom 45 extending between the end walls. The bottom 45 forms half of a cylinder. The side walls are straight and extend upward from opposite edges of the bottom. A top wall 47 is connected to the upper edges of the end walls 37 and 39 and side walls 41 and 43. Formed through the top wall 47 is a rectangular shaped opening 49 through which the material to be mixed may be dumped or pumped into the container.

Located in the container 33 and extending along its central axis is a suction pipe or conduit 51. The suction conduit extends from end wall 37 to end wall 39 and has a plurality of inductor inlets 53 equally spaced apart along its length. End 51A of the conduit 51 is coupled to the inlet 55 of a centrifugal pump 57 which is located on the exterior of the container. Connection of the suction conduit 51 to the inlet 55 is by way of an elbow 59, a valve 61 and a conduit joint 63.

Figure 3:
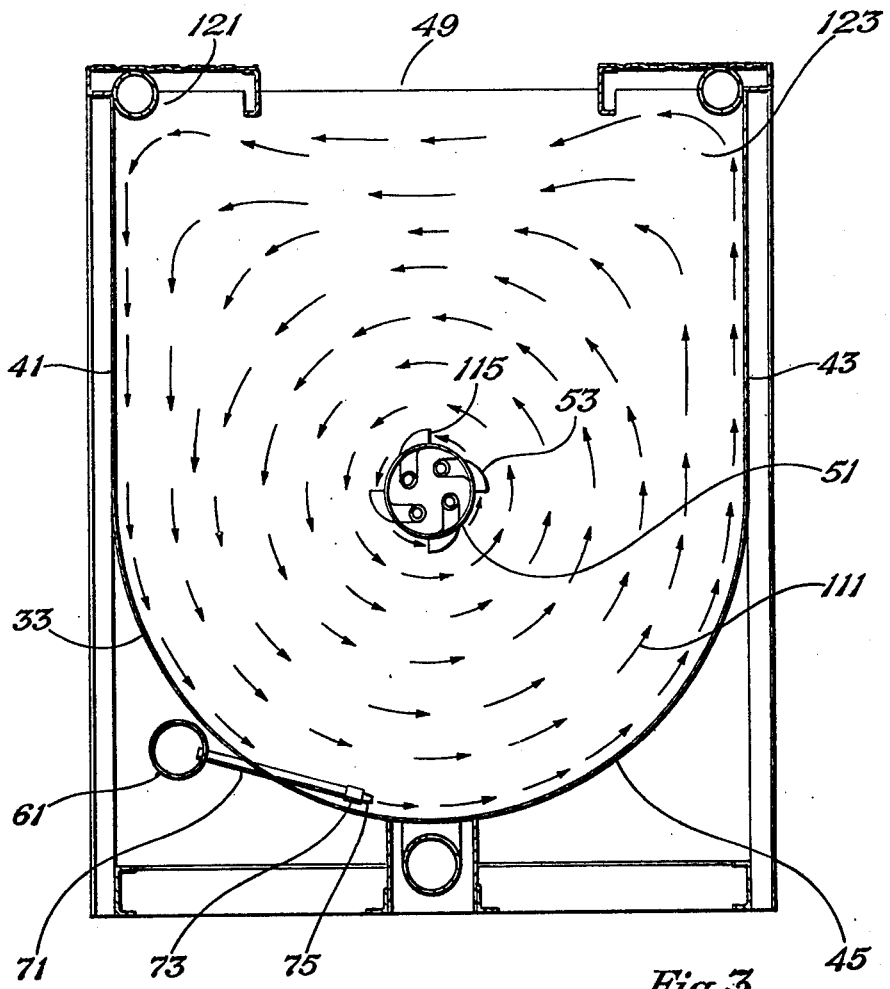
FIG. 3 is a cross-sectional view of the container of FIGS. 1 and 2.

The outlet 59 of the pump 57 is coupled to one end 62A of a conduit or header 62 which is also located on the exterior of the container 33 and extends along the length thereof. Connection of the outlet 59 to the header 62 is by way of conduit 65, conduit 67, and valve 69. Extending from the conduit 62 are a plurality of spaced apart injector conduits 71 which extend into container 33 for injecting fluid into the container. The injector conduits 71 are equally spaced apart. The ends of the injector conduits have couplings 73 attached thereto to which are attached injector nozzles 75. As seen in FIG. 3 the injector conduits 71 extend into the container 33 tangentially with respect to the curved bottom wall 45.

Also coupled to the conduit joint 63 and hence to the inlet 55 of the pump are two external intake conduits 81 and 83. Valves 85 and 87 are connected to the conduits 81 and 83, respectively. Two external discharge conduits 91 and 93 are coupled to the outlet 59 of the pump 57. In this respect, discharge conduit 91 is coupled to the outlet 59 by way of conduit 65 and discharge conduit 93 is coupled to the outlet 59 by way of conduits 67 and 65. Valves 95 and 97 are connected to conduits 91 and 93, respectively.

A lower suction conduit 101 is located below the container and has an inlet 103 which is in fluid communication with the bottom of the container 33. The lower suction conduit 101 is connected to the inlet 55 of the pump by way of an elbow 105, a valve 107 and conduit joint 63.

In operation, the chemicals or particles to be mixed with a liquid are dumped into the container either manually or by way of hopper (not shown). Chemicals also may be pumped into the container and when in dry bulk form, the chemicals may be blown into the container. Circulation of the liquid is started before the chemicals or dry particles are added into the container. Either of the external intakes 81 or 83 will be connected to the source of liquid (oil or water) to be mixed with the chemical or particles. Assume that external intake 81 is connected to a liquid source. In addition either or both of the external discharge conduits 91 or 93 will be connected to the facility to which the mixed fluid is to be transported. Assume that external discharge conduit 91 is connected to a mud pump which in turn is connected to a well into which drilling fluid is to be injected. Initially all of the valves 61, 69, 85, 87, 95, 97 and 107 will be closed. These valves may be opened or closed by operating the levers shown. For example, the operating lever of valve 95 is identified at 95A. Valves 69 and 85 will be opened and the pump 57 started to cause the liquid to be pumped from the external intake 81 to the conduit 62. Flow is by way of external intake 81, conduit joint 63, pump intake 55, pump 57, pump outlet 59, conduit 65, conduit 67, valve 69 and then to header conduit 62. From the header 62 the liquid is injected into the container by way of the injection conduits 71. The container 33 is filled until the liquid reaches a desired level above the center suction conduit 51 dependent upon the calculated ratio of liquid to chemicals or particles to be mixed. When the container has been filled to the desired level valve 85 is closed and valve 61 opened. This causes the liquid in the container to flow through the inductor inlets 53 and into the suction conduit 51 and then to the pumped back into the header 62 and injected back into the container by way of the injector conduits 71. Flow from the center suction conduit 51 is by way of elbow 59, valve 61, conduit joint 63, pump inlet 55, pump 57, pump outlet 59, conduit 65, conduit 67, valve 69, header 62 and injection conduits 71. Thus, the liquid is circulated from the container into the inductor inlets and through the center section conduit 51, the pump, the header 62, and back into the container by way of the injector conduits 71.

Figure 5:
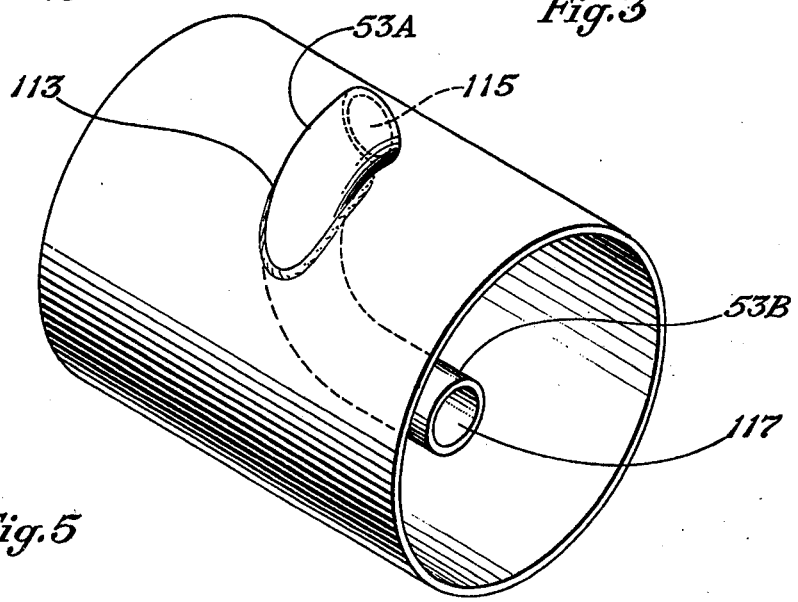
FIG. 5 is an enlarged perspective view of a portion of the central suction pipe or conduit employed in the container of FIGS. 1–3 and which illustrates one of the inductor inlets.
Figure 4:
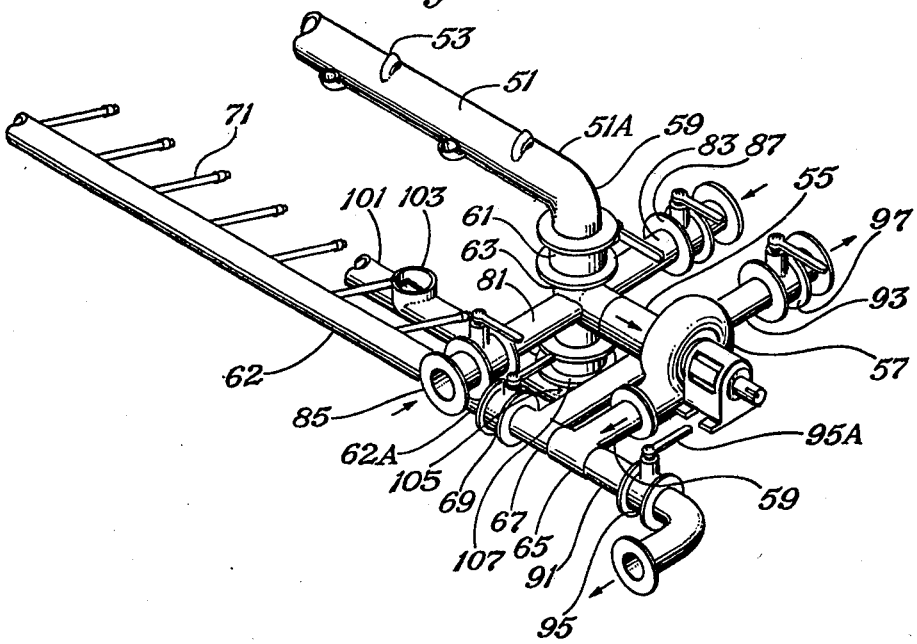
FIG. 4 is a perspective view of the pumping and circulating system used in the mixing system but with the container of FIGS. 1–3 removed for purposes of clarity.

After circulation of the liquid has begun, the chemicals or particles to be mixed with the liquid are added into the container. Circulation is continued to achieve mixing. As stated above, the injector conduits are located such that fluid is injected from their nozzles tangentially to the curvature of the container bottom whereby the fluid injected follows a circular path around the container and hence around the center section conduit 51 as depicted by the arrows 111. The fluid injected into the circular path causes the fluid in the tank to swirl with it whereby a secondary flow is induced and a sweep action is obtained across the bottom of the container which prevents chemicals or other materials from settling to the container bottom. The suction drawn on the suction conduit 51 by the centrifugal pump causes the fluid in the container 33 to spiral inward around the suction conduit. As the fluid spins inward the velocity increases and a pressure drop is experienced between the exterior and interior wall of the suction conduit 51 which may be detrimental to the quantity of fluid pumped through the suction conduit 51 if the inductor inlets 53 were merely perforations formed in the wall of the suction conduit 51. The effect of the pressure drop is overcome by the use of the inductor conduits 53. Referring to FIG. 5 each inductor conduit comprises a conduit 53 extending through an opening 113 formed in the wall of the suction conduit 51 and has a portion 53A located outside of the suction conduit 51 and a portion 53B located inside of the suction conduit. The exterior portion 53A is turned to have its opening 115 facing in a direction opposite the direction of flow of the fluid around the suction conduit 51 such that a pressure impact is created against the opening 115 of the inductor 53. Thus, velocity is converted to pressure and the effect of the pressure drop is overcome whereby a large quantity of fluid may be pumped through the suction conduit 51. The outlet of conduit portion 53A into conduit 51 is off center with respect to the axis of conduit 51. In order to prevent the fluid flowing through conduit 53A from swirling inside conduit 51 and to start the fluid flowing to the pump, the inside portion 53B of the inductor has its opening 117 facing in the direction of the flow of the fluid in the suction conduit 51 to the centrifugal pump as seen in FIG. 5.

In one embodiment, 24 inductors 53 and 12 injector conduits 71 are employed. The inductors 53 are equally spaced apart and are each of the same size whereby an equal quantity of fluid will be extracted through the suction conduit 51 at 24 equally spaced locations along the length of the suction conduit. The fluid will be further mixed by passing through the pump 57 due to turbulence or high shearing caused by the blades or vanes of the centrifugal pump. The injector conduits 71 are equally spaced apart and the injector conduits including their nozzles 75 are of the same size.

Inside the container 33, turbulence is created at the upper corners 121 and 123 due to the fact that these corners are not rounded. This is desirable since it enhances mixing of the chemicals or particles and the liquid. Extraction of a better mixed fluid from the container also is achieved by locating the suction conduit 51 in the center rather than at the periphery of the container. In this respect, if the extracting suction conduit 51 were located at the periphery of the container, a large mass of rotating fluid would exist in the center which would not be properly mixed whereby maximum mixing would not be achieved.

As indicated above, it has been assumed in this example that the external discharge conduit 91 is connected to a mud pump which in turn is connected to the drill pipe inside of a well into which drilling fluid is to be injected. When the liquid has been mixed properly, valves 107 and 95 are opened and valves 69 and 61 are closed whereby the fluid in the container is pumped to the external discharge conduit 91 by way of inlet 103, lower suction conduit 101, elbow 105, valve 107, conduit joing 63, inlet 55, pump 57, outlet 59, and conduit 65. Since the lower suction conduit 101 is located below the bottom of the container, 100% of the fluid can be evacuated from the container leaving nothing in the container which is important if the fluid is expensive which generally is the case for drilling fluid.

Location of the header conduit 62 outside rather than inside the container has advantages since it avoids the collection of materials (which do not go into solution) behind the header which would otherwise occur if the header were located in the container next to its wall. Although the header 62 is disclosed as being located at the bottom of the container it is to be understood that it could be located at other positions as long as secondary flow can be induced to achieve a sweep across the bottom of the container to prevent chemicals from dropping out and settling to the bottom.

Examples of chemicals which may be mixed with water or oil in the present system to form drilling fluids are as follows: Barium sulfate, Calcium carbonate, high yielding clay, sodium chloride, etc. Examples of other materials which may be mixed with oil or water in the present system to form a drilling fluid are ground paper, walnut hulls, mica, cotton seed, etc.

In one embodiment, wherein the container 33 is a cylinder, it has a length of 24 feet and a diameter of 8 feet. The capacity of the container is 214 barrels of liquid. Suction tube 51 has a diameter of about 10 inches and the diameter of header 62 decreases in steps from its upstream to its downstream end. For the first 12 feet, the diameter of header 62 is 8 inches, the next 8 feet its diameter is 6 inches and the last 4 feet, its diameter is 4 inches. The inductors 52 are spaced one foot apart and each has a diameter of two inches. The injection conduits 71 are spaced two feet apart. The diameter of each nozzle is the same and is 13/16 of an inch. The lower suction pipe 101 has a diameter of 8 inches and has one inlet 103. The centrifugal pump 57 has a 6 inch diameter outlet and an 8 inch diameter inlet. It has a hydraulic horsepower output of 110 h.p. at 1800 rpm with water, and a water rating of nearly 2000 gallons per minute. It is run at about 1800 rpm by a 4-71 Detroit diesel having an output of about 160 h.p.

It is to be understood that the mixing system may have dimensions other than that disclosed above and employ a pump with a different flow and pressure rating.

Although the bottom 45 of the container 33 preferably is cylindrical in shape it could have other curved shapes to promote streamline flow. In addition, although the pump 57 is a centrifugal pump other types of pumps could be used such as a piston type pump, a gear pump, etc.

In some cases, it may be desirable to mix only a small quantity of liquid with a desired amount of chemical or particles such that the liquid desired to be mixed does not reach to the level of the suction conduit 51. In this case, the lower suction conduit 101 will be used rather than the central suction conduit 51 to extract the liquid from the container for re-circulation to the container by way of the pump 57, the header 61 and the injection conduits 71. The container is filled with liquid to the desired level, and circulation is carried out by opening valves 107 and 69 to extract the fluid from the container by way of the inlet 103, the lower suction conduit 101, the pump 57, and then to re-inject the fluid into the container through the header 62 and the injection conduits 71. After circulation of the liquid has been started, the chemicals or particles to be mixed with the liquid are added and circulation continued to achieve mixing. Valve 61 will be closed during the circulation and mixing operation. After mixing has been achieved, the fluid is pumped from the container to the desired facility in the same manner described above with respect to the preferred embodiment.

The purpose of the top header jet conduits 124 is to wet lost circulation material during mixing which may float on top of the liquid. The jet conduits 124 are connected to a top header (not shown) which is connected to the pump outlet 59 by means not shown, whereby a portion of the fluid injected through the outlet 59 will be injected through the top header and then injected into the container by way of the jet conduits 124. In most instances the top header and jet conduits 124 will not be used.

Figure 6:
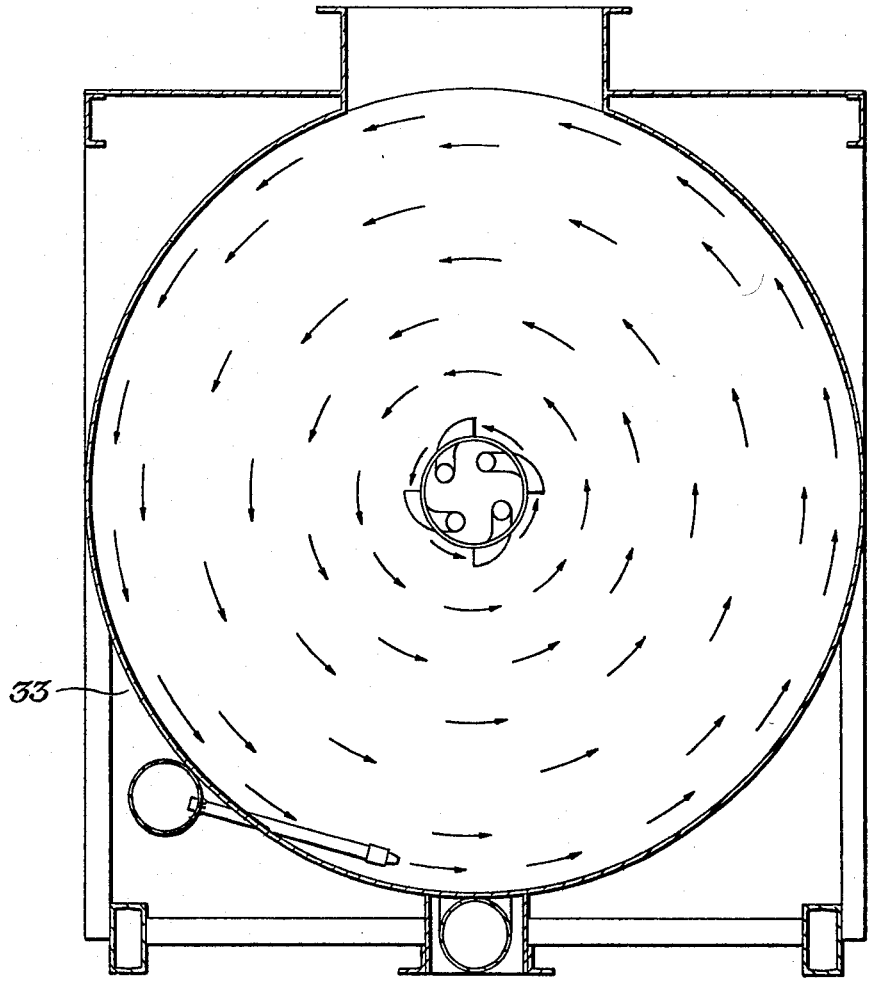
FIG. 6 is a cross-sectional view of a modified container which may be employed in the mixing system.

Referring to FIG. 6, there is disclosed another embodiment wherein the container 33 is in the form of a cylinder and does not have the straight upper side walls and top as does the embodiment of FIG. 1. This system operates in the same manner as that of the embodiment of FIG. 1, however, the turbulence at the upper corners 121 and 123 is eliminated since these right-angle corners have been eliminated. Thus, the embodiment of FIG. 6 will achieve maximum flow through the pump where maximum shearing occurs on the fluid due to the rotating action of the blades or vanes of the centrifugal pump.

In certain instances, it may be desirable to provide vortex generators in the container of the embodiment of FIG. 6 to obtain swirl or turbulence to enhance mixing of the chemicals or particles with the liquid. Such vortex generators may comprise a piece of metal with a helical twist, located to cause a secondary swirl in the direction of flow to create more shear and hence turbulence.

Although it is desirable to have turbulence within the container 33 it is more desirable to have an even flow around the suction conduit 51. This is achieved by locating the various inductors 53, 90° apart. It is to be understood, however, that the inductors could be all lined up with respect to each other if desired. Although the system was disclosed as having twenty-four inductors 53 and twelve injectors 71, the number of injectors 71 could equal to the number of inductors 53. Similarly, in the preferred embodiment, the inductors 53 and the injectors 71 are equally spaced apart, however, in some cases they may not be equally spaced apart.

DESCRIPTION OF THE PREFERRED EMBODIMENT

Figure 7:
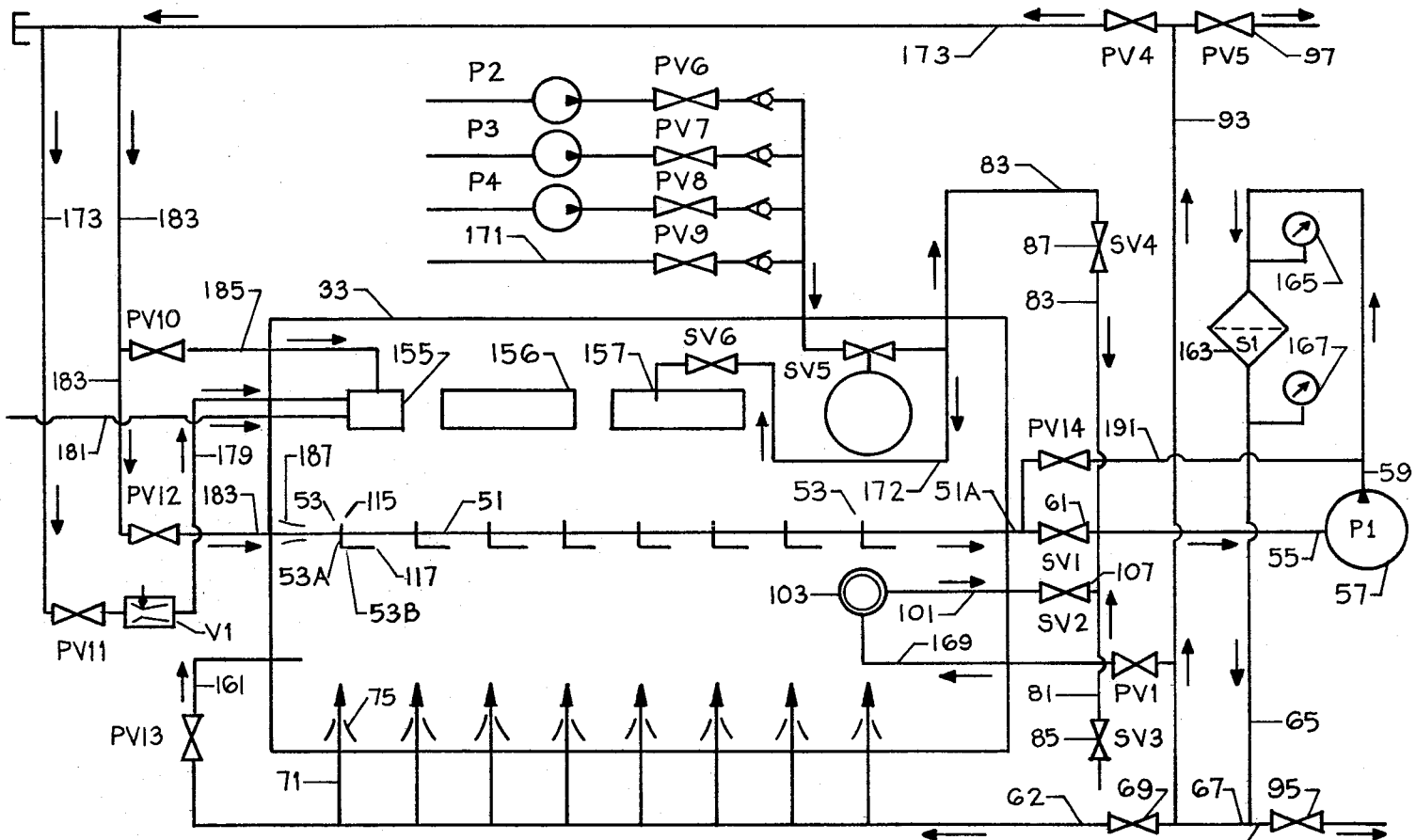
FIG. 7 is a schematic view of the mixing system showing the present invention.

Referring now to FIG. 7, a fluid mixing system is illustrated schematically. Like components have been identified by like reference numerals as disclosed in FIGS. 1–6. In FIG. 7, components P1, SV1, SV2, PV3, PV5, PV2, SV4 and SV3 correspond with components 57, 61, 107, 95, 97, 69, 87 and 85 respectively. The container 33 is the cylindrical container of FIG. 6. The fluid mixing system comprises the container 33, the center suction 51 having the inductors 53, valve 61 (SV1), pump 57 (P1) having inlet 55 and outlet 59, conduit 65, discharge conduit 91 with valve 95 (PV3), conduit 67 and discharge conduit 93 with valve 97 (PV5). The fluid mixing system also comprises valve 69 (PV2), header 62, injector conduits 71 with nozzles 75, lower suction 101 with inlet 103 and valve 107 (SV2). Although only eight inductors 53 and only eight injectors 71 are shown, the system has twenty-four inductors 53 and twelve injectors 71. Also included is intake conduit 81 with valve 85 (SV3) and intake conduit 83 with valve 87 (SV4). These components are the same as disclosed in FIGS. 1–6 and the system operates in the same manner for mixing fluids.

The system also includes three access risers 155, 156 and 157 coupled to the top of the container for inserting material therein. One of the risers is shown in FIG. 6. A conduit 161, with valve PV13, is coupled to header 62 for blowing out the header 62 in the event it becomes plugged. Conduit 169 with valve PV1 extends to the lower suction conduit 101 for blowing out the conduit 101 in the event that it becomes plugged.

Pumps P2, P3 and P4 are employed for injecting brine, fresh water, diesel fuel into intake conduit 83. Mud is applied by way of conduit 171 to the intake conduit 83. Valves PV6, PV7, PV8, PV9 control the fluid flow from pumps PV6, PV7, PV8 and conduit 171. Valve SV5 is a float actuated valve which automatically shuts off if the fluid level in container 45 becomes too high. Conduit 172 and valve SV6 may be employed for injecting fluid into the container 33 through riser 157. A similar fluid injecting arrangement as described above may be coupled to intake conduit 81.

Conduit 173, with valve PV4, extends to the rear of the container to a valve PV11 and a jet pump and sack hopper V1. The jet pump is used to induce material from the sack hopper which then is transported with the fluid up to riser 155 and into the container 53 by way of conduit 179. Barite may be pneumatically injected into riser 155 through conduit 181. Conduits 183 and 185 supply fluid through valve PV10 to wet down the barite injected into riser 155.

Fluid also is injected into the rear end of the suction conduit 51 by way of conduit 183, valve PV12, and nozzle 187. The nozzle 187 is a ¾ inch diameter nozzle. The purpose of injecting fluid into the rear end of the suction conduit 51 through nozzle 187 is to induce more flow through the rear inductors 53 from the container 33 into the center suction 51 whereby flow through each of the inductors 53 will be equalized. This feature has been used commercially on the fluid mixing system for several years.

As mentioned above, when mixing lost circulating material, if the container is allowed to become too full whereby the fluid goes up into the access risers 155, 156, 157, the inductors 53 become plugged when the contents of the container 33 are discharged. In accordance with the present invention, conduit 191 and valve PV14 are employed for blowing or cleaning out the inductors. The conduit 191 is a six diameter conduit having one end coupled to the outlet 59 of the pump 57 and the other end coupled to the suction conduit 51 at its outlet end 51A between valve 61 and the forward most inductor 53. Since the openings 117 of all of the inductors 53 face the outlet end 51A of the suction conduit 51, conduit 191 coupled to suction conduit 51 at its outlet end 15A is effective in blowing or cleaning out all of the inductors.

When fluid is withdrawn from center suction 51 and recirculated through injectors 71 for mixing purposes (assuming all of the material to be mixed with the fluid has been injected into the container), valves PV5, PV3, SV3, SV4, PV14, SV2, PV1, PV6, PV7, PV8, PV9, PV10, PV11 and PV13 are closed and valves SV1, PV2, PV4 and PV12 are opened. Fluid then is withdrawn into the center suction 51 through inductors 53 and injected back into the container 33 by way of pump P1, header 62 and injectors 71. Fluid also is injected into the rear of the center suction 51 by way of conduit 93, valve PV4, conduit 173, valve PV12 and nozzle 187, to induce more flow through the rear inductors from the container 33 into the center suction 51.

When it is desired to clean out the inductors 53, assuming some fluid is in the container, valves PV14 and SV2 are opened and the remainder of the valves PV5, PV4, PV3, PV2, SV4, SV3, PV1, SV1, PV6, PV7, PV8, PV9, PV10, PV12, PV11 and PV13 are closed. Fluid then is withdrawn from the container by way of the lower suction conduit 101 and injected into the center suction by way of pump P1 and conduit 191. The high pressure fluid flows into the center suction 151 and through each of the inductors 53 by way of inductor portions 53B and 53A.

I claim:

1. A fluid mixing system comprising:

a container having a given length, injection means for injecting fluid into said container in a direction to cause the fluid to swirl around an axis along the length of said container, first suction conduit means located in said container generally along said axis and having a plurality of spaced apart inlet means along its length for the flow of fluid from said container into said first suction conduit means, each of said inlet means comprising an inductor conduit having a portion which extends into said first suction conduit means and which has an opening within said first suction conduit means which faces one end of said first suction conduit means, pump means having an inlet coupled to said one end of said first suction conduit means and an outlet coupled to said injection means, second suction conduit means coupled to the bottom portion of said container and to said inlet of said pump means, first valve means coupled between said one end of said first suction conduit means and said inlet of said pump means, second valve means coupled between said outlet of said pump means and said injection means, third valve means coupled to said second suction conduit means, a reverse flow conduit means coupled from said outlet of said pump means to said first suction conduit means at a position between said first valve means and said inlet means, and fourth valve means coupled to said reverse flow conduit means, said pump means being allowed to withdraw fluid from said first suction conduit means for flow to said injection means for injection back into said container when said first and second valve means are open and said third and fourth valve means are closed, said pump means being allowed to withdraw fluid from said container by way of said second suction conduit means for flow into said first suction conduit means by way of said reverse conduit means for cleaning out said inductor conduits when said third and fourth valve means are open and said first and second valve means are closed.

2. The fluid mixing system of claim 1, wherein:

said injection means injects fluid into said container in a direction to cause the fluid to swirl around a central axis along the length of said container, said first suction conduit means being located in said container generally along said central axis.

3. The fluid mixing system of claims 1 or 2, wherein:

each of said inductor conduits have a portion located outside of said first suction conduit means with an opening facing in a direction opposite the direction of flow of fluid around said first suction conduit means.

4. A fluid mixing system, comprising:

a container defined by two spaced apart end walls with side wall portions and a rounded bottom wall portion extending between said end walls, the distance between said end walls defining the length of said container, first conduit means located in said container at a generally central position relative to said side wall and bottom wall portions and extending along the length of said container, said first conduit means having a plurality of spaced apart inlet means along its length for providing a plurality of spaced apart flow passages from the interior of said container into said first conduit means, second conduit means extending along the length of said container, a plurality of spaced apart injection conduit means coupled to said second conduit means along its length and located to inject fluid into said container in a direction to cause said fluid to follow a swirling path around said first conduit means, each of said inlet means comprising an inductor conduit having a portion outside of said first conduit means with an opening which faces in a direction opposite the direction of flow of fluid around said first conduit means and a portion which extends into said first conduit means and which has an opening within said first conduit means which faces one end of said first conduit means, pump means having an inlet coupled to said one end of said first conduit means and an outlet coupled to said second conduit means, third conduit means coupled to the bottom portion of said container and to said inlet of said pump means, first valve means coupled between said one end of said first conduit means and said inlet of said pump means, second valve means coupled between said outlet of said pump means and said second conduit means, third valve means coupled to said third conduit means, a reverse flow conduit means coupled from said outlet of said pump means to said first conduit means at a position between said first valve means and said inlet means, and fourth valve means coupled to said reverse flow conduit means, said pump means being allowed to withdraw fluid from said first conduit means for flow to said second conduit means for flow back into said container by way of said plurality of injection conduit means when said first and second valve means are open and said third and fourth valve means are closed, said pump means being allowed to withdraw fluid from said container by way of said third conduit means for flow into said first conduit means by way of said reverse conduit means for cleaning out said inductor conduits when said third and fourth valve means are open and said first and second valve means are closed.

5. The fluid mixing system of claim 1 wherein said injection means comprises a plurality of nozzles.

6. The fluid mixing system of claim 5 wherein the cross-sectional size of each of said nozzles is less than the cross-sectional size of each of said inductor conduits.

7. The fluid mixing system of claim 6, wherein the cross-sectional size of each of said nozzles is less than the cross-sectional size of each of said inlet means.

8. The fluid mixing system of claim 4, wherein said plurality of spaced apart injection conduit means comprises a plurality of nozzles coupled to said second conduit means along its length.

* * * * *